US005699926A

United States Patent [19]

Jacques et al.

[11] Patent Number: 5,699,926

[45] Date of Patent: Dec. 23, 1997

[54] FIVE-PIECE CONTAINER WITH STABILIZER TABLET

[75] Inventors: Michel Jacques, St-Damien-de-Buckland; Roch Nolet, St-Joseph-de-Beauce, both of Canada

[73] Assignee: IPL, Inc., St.-Damien-De-Bellechasse, Canada

[21] Appl. No.: 696,242

[22] Filed: Aug. 13, 1996

[51] Int. Cl.[6] ..... B65D 21/00

[52] U.S. Cl. ..... 220/6; 220/512; 206/199

[58] Field of Search ..... 220/6, 509, 512; 206/199, 203

[56] References Cited

U.S. PATENT DOCUMENTS

| | | | |
|---|---|---|---|
| 1,236,589 | 8/1917 | Miller | 206/199 X |
| 2,510,591 | 6/1950 | Listman | 206/199 |
| 3,106,308 | 10/1963 | Kazimier | 220/512 |
| 3,297,191 | 1/1967 | Eastman | 220/21 |
| 3,360,180 | 12/1967 | Venturi | 220/6 X |
| 4,044,910 | 8/1977 | Box | 220/6 X |
| 5,439,110 | 8/1995 | Regan, II | 206/199 X |
| 5,538,153 | 7/1996 | Marovskis et al. | 220/6 |

*Primary Examiner*—Steven M. Pollard

*Attorney, Agent, or Firm*—Wells, St. John, Roberts, Gregory & Matkin, P.S.

[57] ABSTRACT

The invention described consists of a five-piece container for carrying bottles and of a stabilizer tablet for steadying the bottles in their vertical position in the container. The container comprises a bottom piece formed of plastics material and of opposite side pieces and opposite end pieces also formed of plastics material and hingedly connected to the side and end edges of the bottom piece whereby the side pieces and the end pieces may be pivoted between an erected position and an outward foldback position and vice-versa. The stabilizer tablet consists of a flat board displaying a series of openings each having a size to engage the neck portions of the bottles and to thereby minimize up, down, and sideway movements of the bottles in the container.

12 Claims, 6 Drawing Sheets

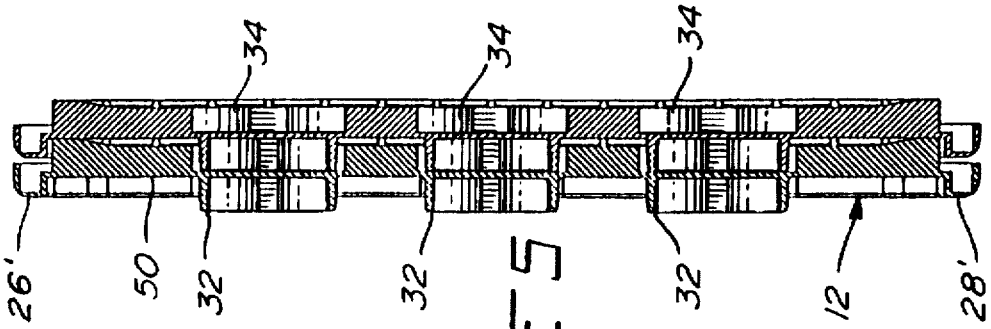
FIG. 5
FIG. 4
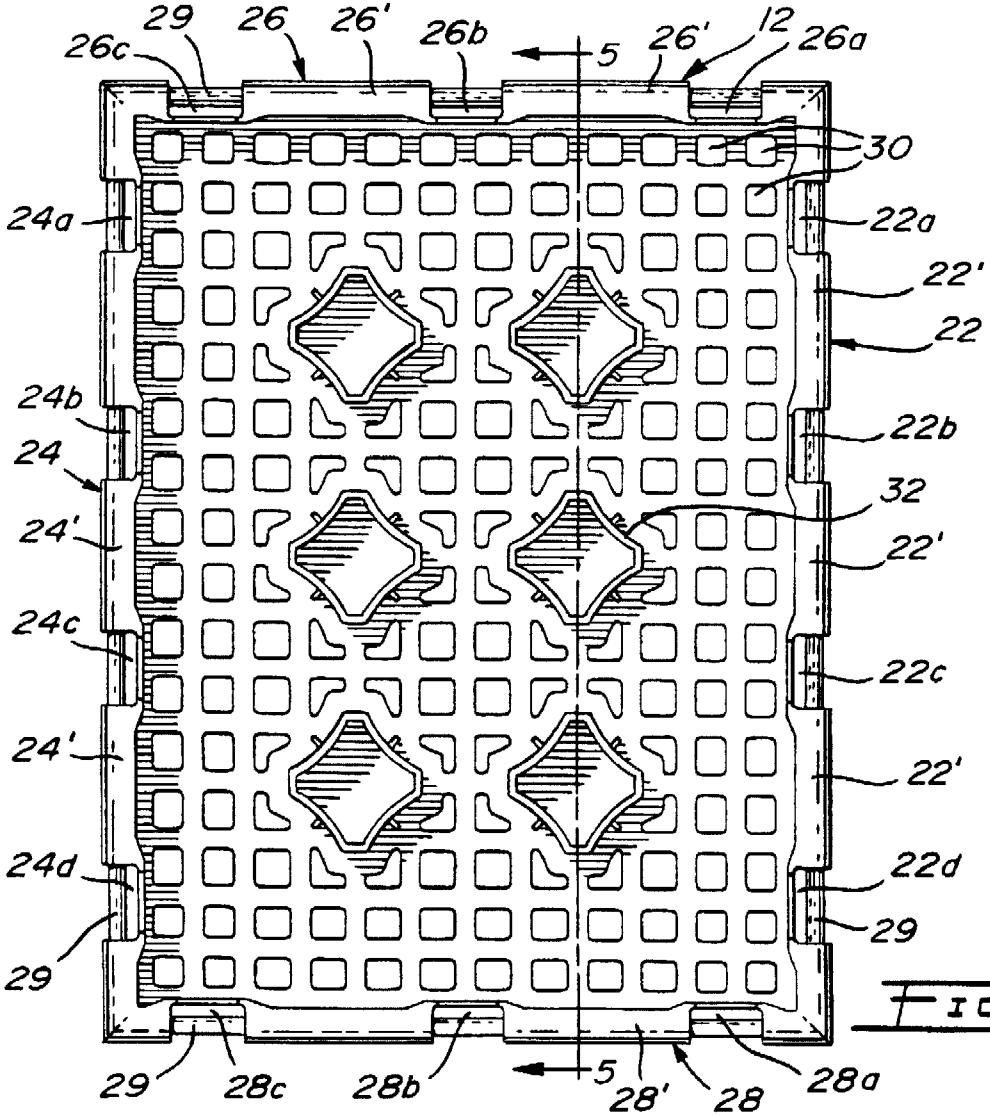

FIVE-PIECE CONTAINER WITH STABILIZER TABLET

FIELD OF THE INVENTION

The present invention pertains to an improved container to separately receive a plurality of bottles therein. More particularly, the present invention pertains to a five-piece container for carrying bottles which is provided with stabilizer means for steadying the bottles in their vertical position in the container to thereby minimize the up, down and sideway movements of the bottles in the container.

BACKGROUND OF THE INVENTION

Different types of separators are presently used in bottle-receiving containers to protect the bottle or the labels, or both. These separators are made of cardboard or plastic; they may consist of a separate unit placed in the containers, vertically extending between the bottles or they may be molded in one piece with the container. If the interior of the container is to be protected from dust or dirt, then a lid is incorporated to the container. This lid is also made of plastics material or cardboard and can be part or incorporated with the container when they are fabricated in one piece with the contour of the container.

OBJECTS AND STATEMENT OF THE INVENTION

An object of the present invention is to provide a novel system to separate bottles in containers in order to protect the bottles or their labels, or both. This is achieved by providing, on the bottom of the container, a plurality of short bottle-abutting projections configured to contact the lower edges of bottles placed thereon and also by providing a separate stabilizer means which consists of a tablet member having a series of openings to receive the neck of the bottles therethrough. The combination of projections and tablet member minimizes up, down and sideway movements of the bottles in the container.

Therefore, the present invention relates to a combination of a five-piece container and of stabilizer means.

(i) the container comprising a) a bottom piece formed of plastics material, the bottom piece having opposite side edges and opposite end edges displaying therebetween a top side and an under side; the top side having, integrally formed thereon, a plurality of short bottle-abutting projections having a configuration to partially contact the lower edges of bottles placed on the bottom piece;

b) opposite side pieces and opposite end pieces formed of plastics material, each side and end pieces having a lower edge; the lower edges of the side and end pieces being hingedly connected to corresponding side and end edges of the bottom piece whereby the side pieces and the end pieces may be pivotally moved between an erected position and an outward foldback position and vice-versa; each side and end piece having opposite lateral edges and interengaging means thereon to enable connection of adjacent side and end pieces together when in the erected position;

(ii) the stabilizer means consisting of a tablet member displaying a series of openings having a size to receive therethrough neck portions of bottles placed on the bottom piece; the tablet member engaging the neck portions of the bottles to minimize up, down and sideway movements of the bottles in the container.

In a preferred form of the invention, the inner faces of the sided end pieces have retaining means to maintain the board member on the bottles.

In another form of the invention, the underside of the bottom piece has a series of recessed areas corresponding in number and in shape to the projections on the top side of the container so that in their outward foldback position, containers of identical construction may be stacked one upon the other with the projections nested in superposed recessed areas.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 4 is a top plan view of the bottom piece;

FIG. 5 is a cross-sectional view taken along lines 5—5 of FIG. 5 and showing two stacked bottom pieces;

DESCRIPTION OF PREFERRED EMBODIMENTS

Figure 1:
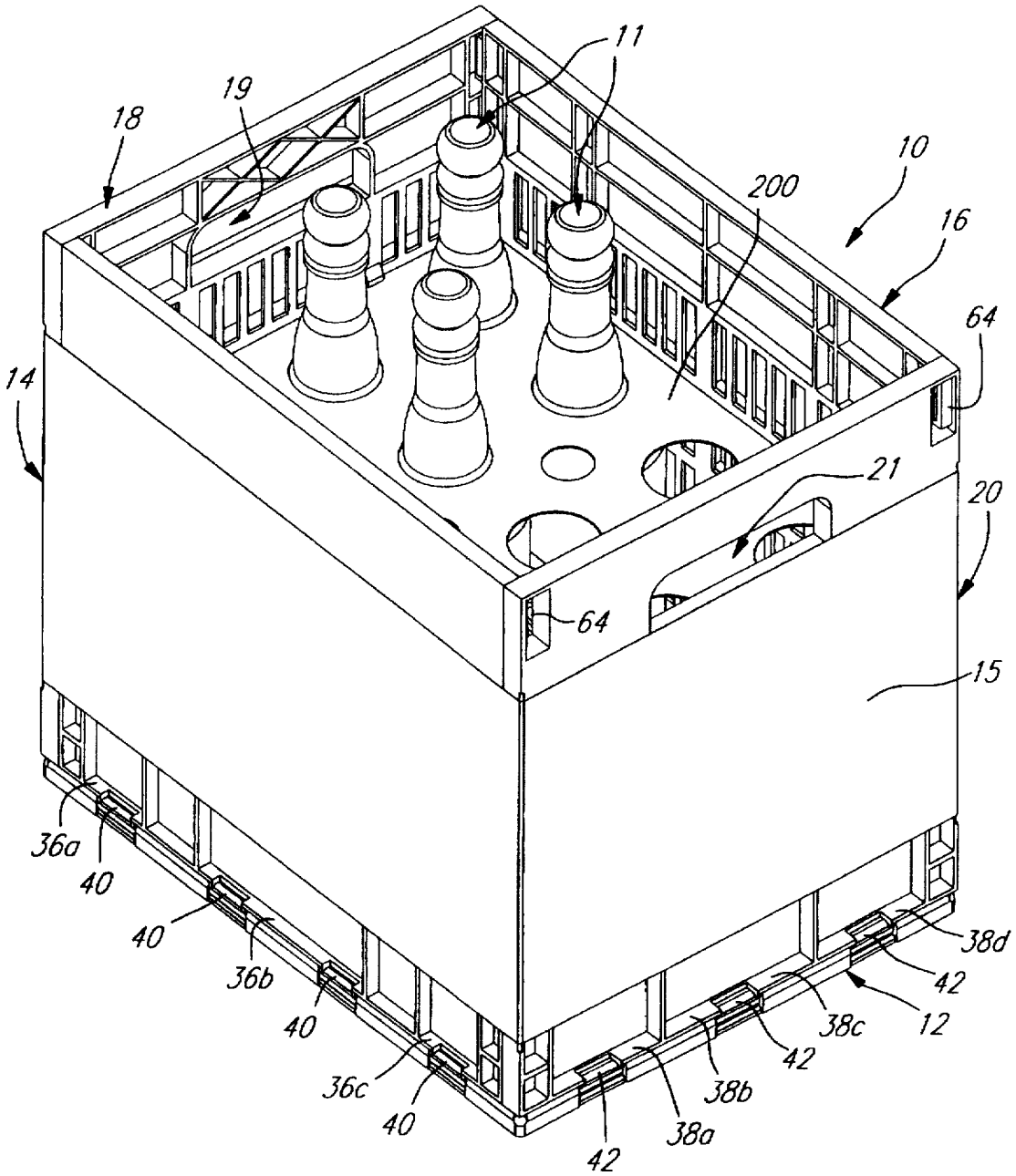
FIG. 1 is a perspective view of a container used for carrying bottles made in accordance with the present invention.
Figure 2:
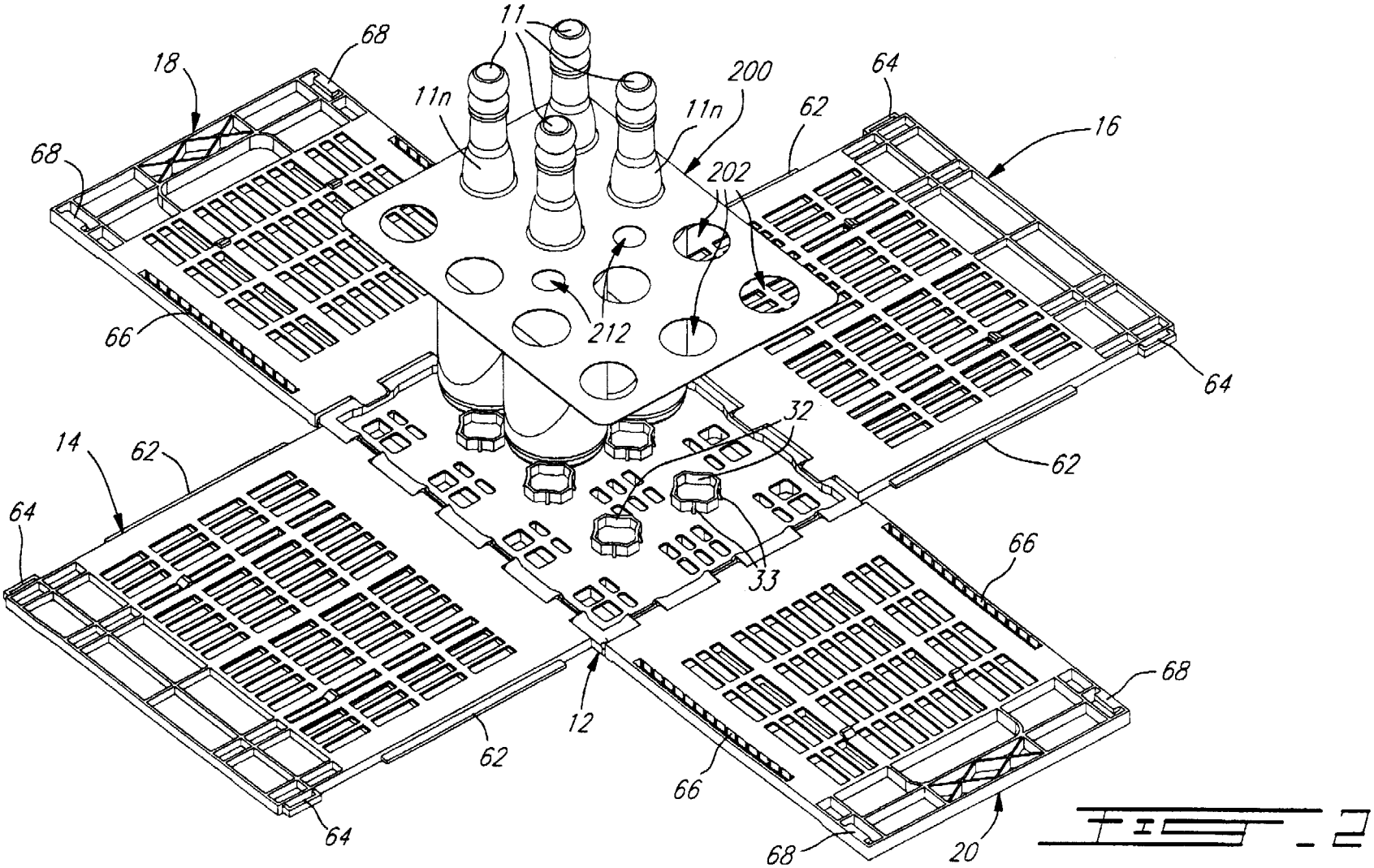
FIG. 2 is a perspective view of the container showing the sides in an outward foldback position.

Referring to FIGS. 1 and 2, there is shown a five-piece container, generally denoted 10, made entirely and solely of rigid plastics material. The container which is used to carry bottles 11 essentially consists of a bottom piece 12, of opposite side pieces 14 and 16 and of opposite end pieces 18 and 20. Handles 19 and 21 are provided in respective end pieces 18 ans 20 to facilitate manual handling of the container. The side pieces and the end pieces are provided with a series of rectangular openings that provide lightness to the container. FIG. 1 shows that the outer faces of the side and end pieces may be covered with a cardboard or like sheet 15 for advertisement.

As shown in FIG. 2, the bottom piece 12 is rectangular with a pair of opposite side edges 22 and 24 and a pair of opposite end edges 26 and 28 (see also FIG. 4). In the embodiment illustrated, the side edges 22 and 24 have a length greater than that of the end edges 26 and 28. Each side edge and each end edge of the bottom piece 12 include a series of horizontally spaced recessed areas identified as **22*a*, 22*b*, 22*c* and 22*d* for side edge 22, as 24*a*, 24*b*, 24*c* and 24*d* for side edge 24, as 26*a*, 26*b* and 26*c* for end edge 26, and as 28*a*, 28*b* and 28*c* for end edge 28. Interspaced with all these recessed areas are respective planar surfaces 22', 24', 26' and 28'** all extending in a common horizontal plane.

Included in each recessed area is a cylindrical hinge 29 which is integrally formed with the edges.

Figure 3:
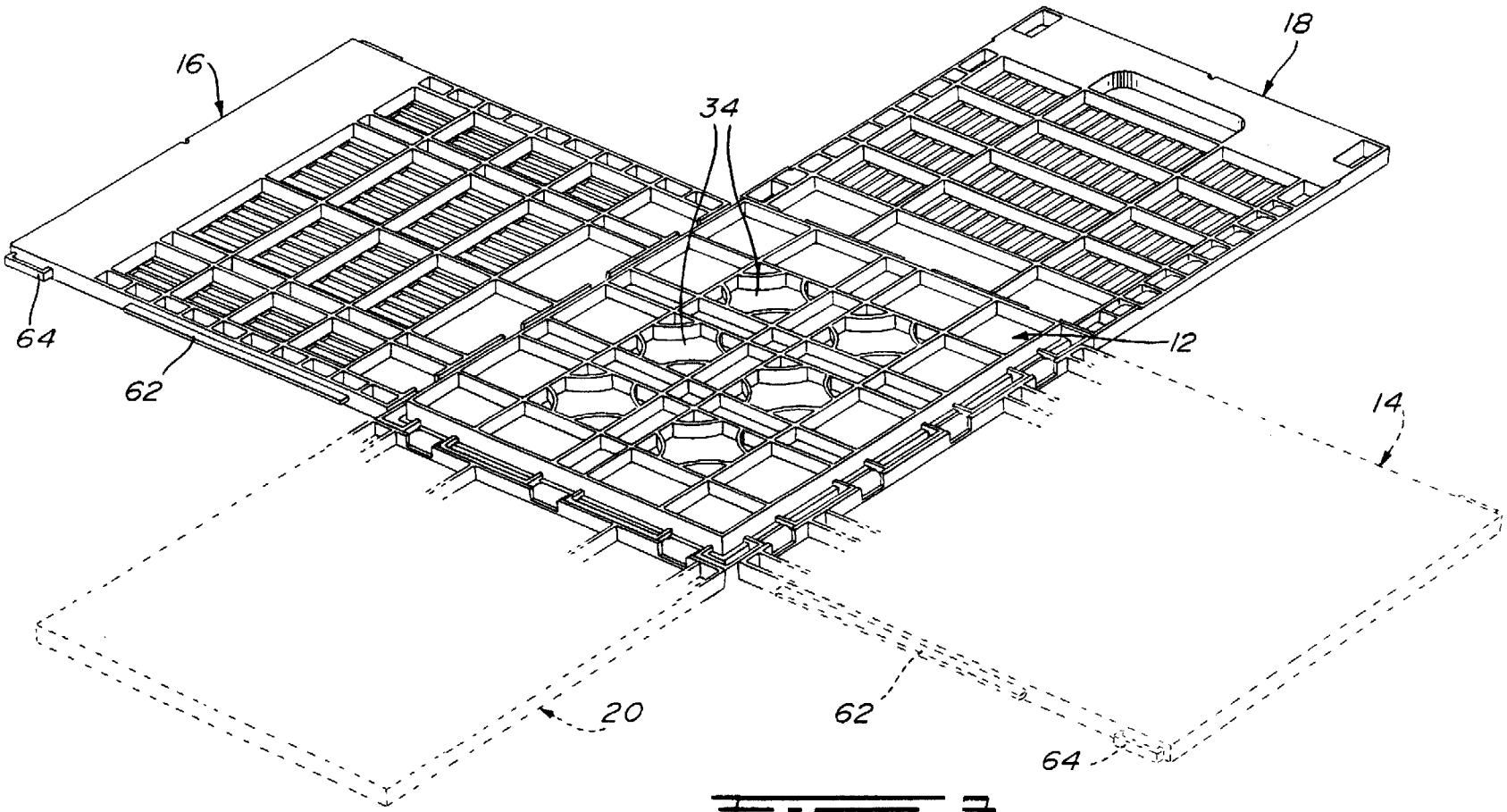
FIG. 3 is a perspective view similar to that of FIG. 2, but showing the underside of the container.

The top side of the bottom piece is recessed with respect to its side edges and end edges and displays a series of raised profiles 32 (six being shown) which serve as abutments for the lower part of bottles resting on the bottom wall 12. Each profile defines a rhomboidal configuration with concave sidewalls displaying a series of small vertical ribs 33 for reinforcement and for washing purposes. As can be seen in FIG. 3, the underside of the bottom wall 12 provides a series of recessed areas 34 with convex sidewalls which are complementary in shape to the profiles 32 so that they may nest therein as illustrated in FIG. 5.

Figure 6:
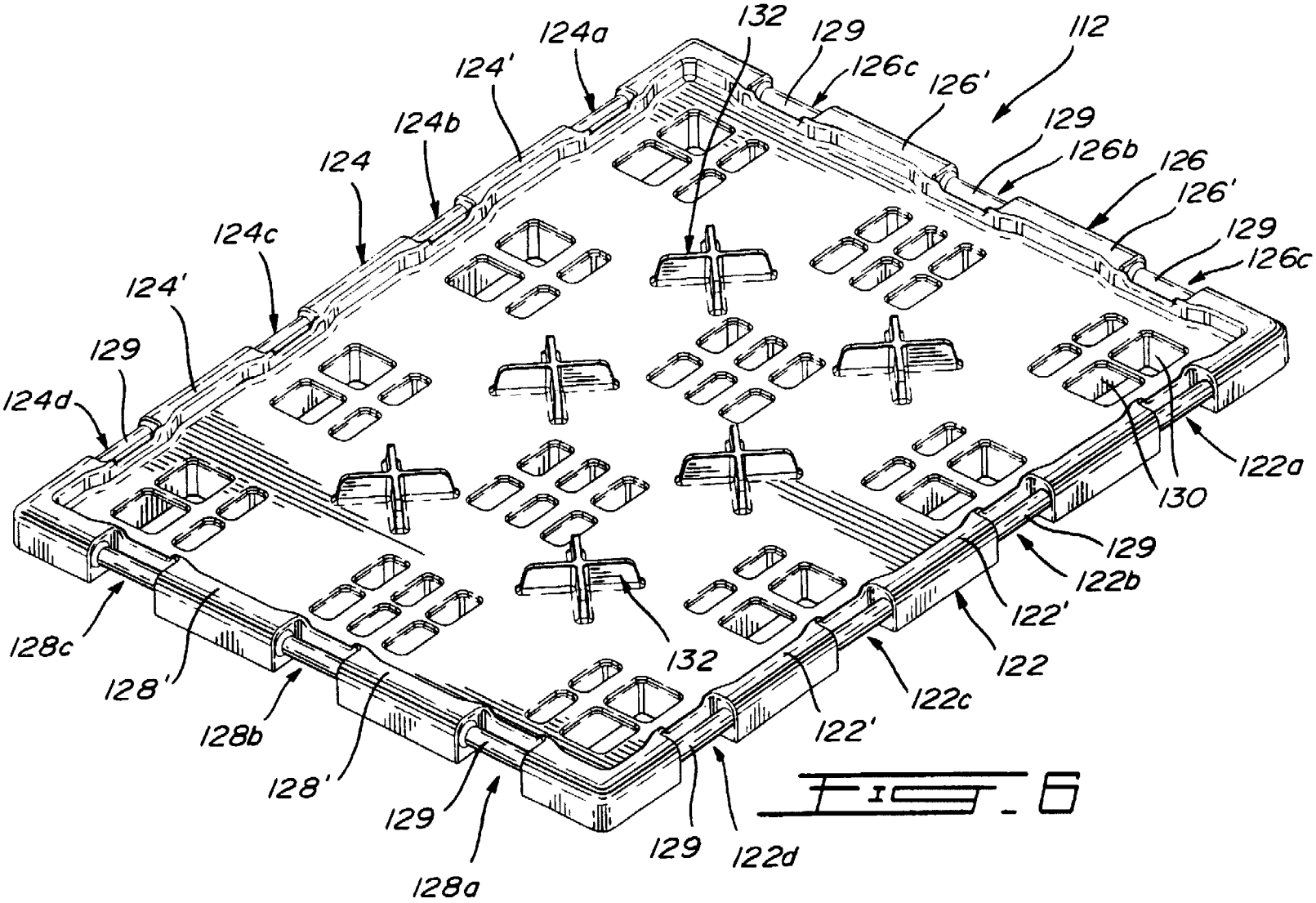
FIG. 6 is a perspective top view of another embodiment of a bottom piece of the container made in accordance with the present invention.

FIG. 6 shows another embodiment of a bottom piece 112 made in accordance with the present invention and which may receive side and end pieces such as those illustrated in FIGS. 1–5.

The bottom piece 112 is rectangular with a pair of opposite side edges 122 and 124 and a pair of opposite end edges 126 and 128. In the embodiment illustrated, the side edges 122 and 124 have a length greater than that of the end edges 126 and 128. Each side edge and each end edge of the bottom piece 112 include a series of horizontally spaced recessed areas identified as **122*a*, 122*b*, 122*c* and 122*d* for side edge 122, as 124*a*, 124*b*, 124*c* and 124*d* for side edge 124, as 126*a*, 126*b* and 126*c* for end edge 126, and as 128*a*, 128*b* and 128*c* for end edge 128. Interspaced with all these recessed areas are respective planar surfaces 122', 124', 126' and 128' all extending in a common horizontal plane. Included in each recessed area is a cylindrical hinge 129** which is integrally formed with the edges.

Figure 7:
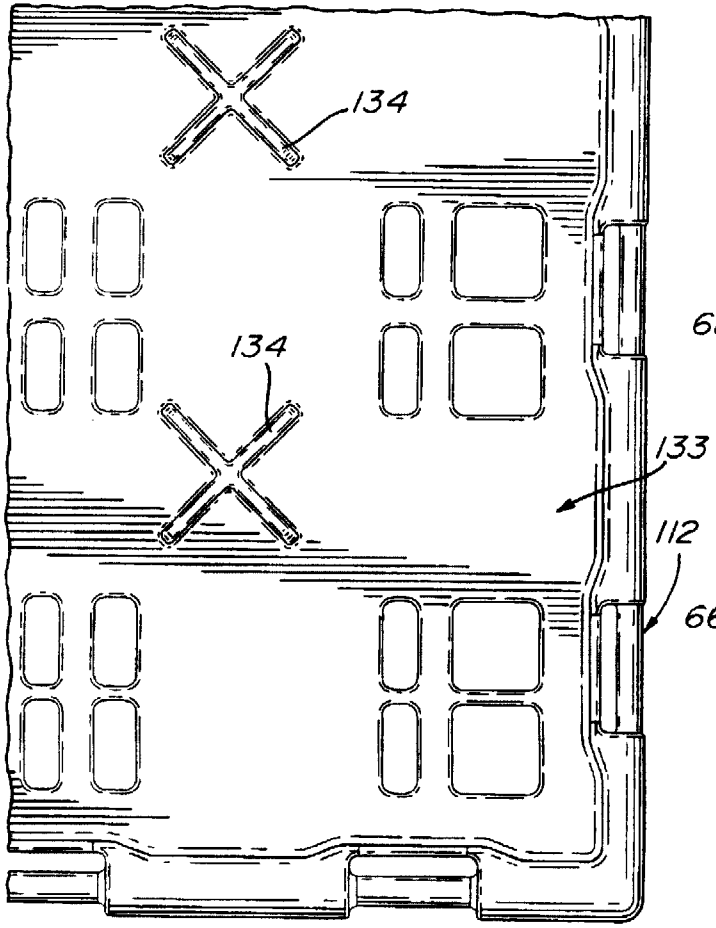
FIG. 7 is an enlarged bottom plan view showing part of the underside of the bottom piece of FIG. 7.

The top side of the bottom piece is recessed with respect to its side edges and end edges and displays a plurality of openings 130 that lighten the container and facilitate washing. The top side also displays a series of raised profiles 132 (six being shown) which serve as abutments for the lower part of bottles resting on the bottom 112. Each profile defines an X-shaped configuration with four sidewalls consisting of vertical ribs. As can be seen in FIG. 7, the underside 133 of the bottom wall 112 includes a series of recessed areas 134 which are complementary in shape to the profiles 132 so that they may nest therein.

Referring to FIG. 2, the lower edge of each side piece 14, 16 and of each end piece 18, 20 are identically shaped. A detailed description of every lower edge will not be given since the lower edges of both side pieces and both end pieces all have the same structural configuration.

Referring to FIG. 1, a side piece comprises, along the lower edge thereof, a series of planar faces **36*a*, 36*b* and 36*c* while an end piece 20 has a series of flat faces 38*a*, 38*b*, 38*c* and 38*d*. Interspaced with these flat surface are C-shaped extensions 40, 42 which are adapted to engage the cylindrical hinges 29 (or 129**) of the bottom piece. A detailed description of this C-shaped profile of an extension that engages a cylindrical hinge may be found described in applicant's U.S. co-pending application Ser. No. 08/502,168 filed Jul. 13, 1995 and is incorporated herewith.

As can be seen in FIG. 1, when the sides 14, 16, 18 and 20 are hingedly pivoted to an erected vertical position, the flat surfaces 40 and 42 of the sides will rest upon the corresponding flat surfaces 22', 24', 26' and 28' (or 122', 124', 126' and 128') of the bottom piece, thus maintaining the sides in vertical position and preventing their inward folding. This is particularly useful when the height of the sides is greater than the width of the bottom piece such as when the height of the side pieces 14 and 16 is greater than the length of the opposite end edges 26 and 28 (126 and 128) of the bottom piece.

Since the container is made of plastics material that has some resiliency, the engagement of the C-shaped profile onto the hinges is effected through a snap-in motion; similarly, a snap-out disengagement is required in order to remove the side pieces, or end pieces, from the bottom piece. The particular connection achieved by the C-shaped extension to the hinges allows the side pieces to move from an outward foldback position to an erected position, or vice-versa.

In order to secure the side pieces and end pieces in the erected position, each has, on its opposite lateral edges, interengaging means which cooperate with complementary interengaging means on the lateral edges of adjacent side pieces. Referring to FIG. 2, one example of such interengaging means may consist of a flange 62 and a U-shaped extension 64, both of which are integrally formed with the side piece, while another interengaging means may consist of a longitudinal slot 66 and of a flexible tongue 68. The flanges 62 are received in corresponding slots 66 while the tongues 68 are flexed for subsequent connection with the U-shaped extensions 64.

The construction of the present invention is extremely useful when it is wished to return the containers for either bottle reloading, repairing or washing. For each case, the four sides are disconnected from one another and moved outwardly to lie in a horizontal plane, common with that of the bottom piece. During transport, the particular construction of the bottom piece enables containers of similar construction to be stacked in their outward foldback position with profiles 32 nestingly received in recesses 34 of superposed containers. For repairing, the damaged pieces may be disconnected from the others by snapping them out from their C-shaped and hinge connections. Thereafter, they are reconnected through a simple snap-in engagement. It is to be noted that the container may be washed with the four side pieces in a vertical position, assembled to one another and to the bottom piece.

Figure 8:
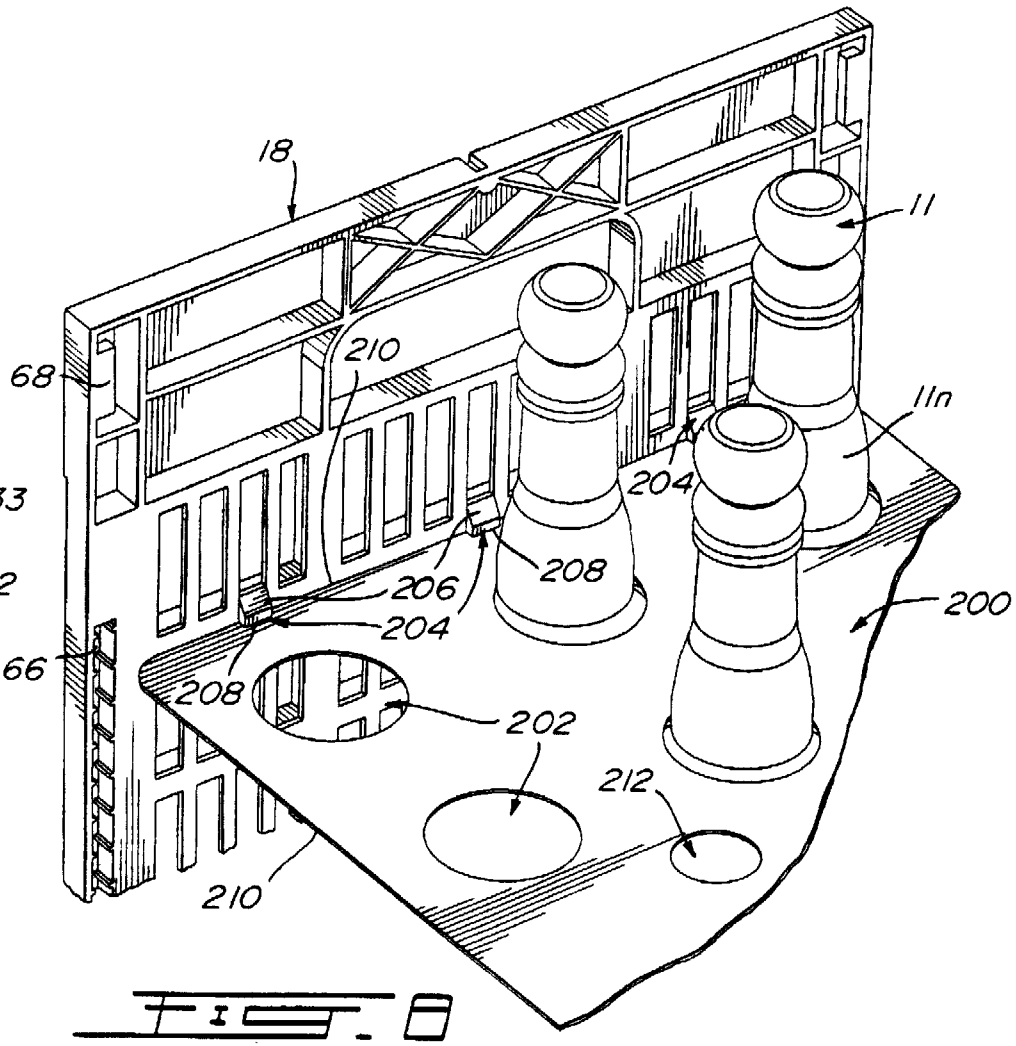
FIG. 8 is an enlarged perspective view showing the engagement of the tablet member to the sides of the container.

Referring to FIGS. 2 and 8, the present invention is concerned with providing a bottle separator or bottle stabilizer 200 in order to retain the bottles 11 in the vertical position, especially during transport and handling of the container. The stabilizer is a flat tablet member that includes a series of circular openings 202 (twelve being shown) to engage the neck portions **11*n* of the bottles. The projections 32 or 132 being of small height, the bottles must receive some additional retaining so that they will not contact one another during handling; this is achieved by the tablet member. To ensure the positioning of the tablet member onto the bottles, the inner face of each side and end pieces are provided with studs 204 (three being shown on end piece 18 in FIG. 8). These studs have a ramp portion 206 and a base 208 so that the edge 210 of the tablet member may slide along ramp portion 206 and engage under the base portions 208 when downwardly inserted onto the bottle necks. The tablet member is preferably made of resilient material, such as cardboard or plastic, so that to remove the tablet member from its engagement to the studs of the side and end pieces, finger insertion through openings 212** is carried out to flex and retrieve the tablet member.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. In combination, a five-piece container for carrying bottles having a body portion and a neck portion and stabilizer for steadying said bottles in said container;

(i) said container comprising:

a) a bottom piece formed of plastics material, said bottom piece having opposite side edges and opposite end edges displaying therebetween a top side and an under side; said top side having, integrally formed thereon, a plurality of short bottle-abutting projections having a configuration to partially contact the lower edges of bottles placed on said bottom piece;

b) opposite side pieces and opposite end pieces formed of plastics material, each side and end pieces having a lower edge; said lower edges of said side and end pieces being hingedly connected to corresponding side and end edges of said bottom piece whereby said side pieces and said end pieces may be pivotally moved between an erected position and an outward foldback position and vice-versa; each said side and end piece having opposite lateral edges and interengaging means thereon to enable connection of adjacent side and end pieces together when in said erected position;

(ii) said stabilizer comprising a tablet member displaying a series of openings having a size to receive therethrough the neck portions, but not the body portions of bottles placed on said bottom piece; said tablet member engaging said neck portions of said bottles to minimize up, down and sideway movements of said bottles in said container; said stabilizer being retained by said side pieces and said end pieces when said side pieces and said end pieces are in the erect position.

2. A combination as defined in claim 1, further comprising retaining means on inner faces of said side and end pieces to retain said tablet member on said bottles.

3. A combination as defined in claim 2, wherein said retaining means consist of studs integrally formed with said inner faces of said side and end pieces.

4. A combination as defined in claim 1, wherein each said bottle-abutting projection defines four contiguous sidewalls integrally formed with said top side of said bottom piece, each sidewall defining a concave profile corresponding to the profiles of the lower edge of a bottle.

5. A combination as defined in claim 4, wherein each said sidewall of said projections comprises reinforcing ribs integrally formed thereon.

6. A combination as defined in claim 4, wherein said under side of said bottom piece comprises a recess in vertical alignment with each said projection on said top side whereby, when said side and end pieces are in said foldback position, bottom pieces of superposed containers may be stacked with said projections of one container being nestingly received in the recesses of a superposed container.

7. A combination as defined in claim 1, wherein each said bottle-abutting projection defines an X-shaped configuration with four walls integrally formed with said top side of said bottom piece and adapted to receive, between pairs of said sidewalls, lower edges of bottles.

8. A combination as defined in claim 1, wherein said tablet member is made of cardboard.

9. A combination as defined in claim 1, wherein said tablet member is made of plastics material.

10. A combination as defined in claim 1, wherein said tablet member comprises finger gripping openings allowing said tablet member to be placed on and removed from said bottles.

11. A combination as defined in claim 1, wherein said interengaging means consist of flanges and flange receiving recesses and of flexible tongues and tongue-engaging members.

12. A combination as defined in claim 1, wherein each said lower edge of said side pieces and of said end pieces includes a series of flat faces and a series of horizontally spaced extensions, each extension defining a C-shaped profile between said faces; and wherein each said side edge and each said end edge of said bottom piece display a series of planar surfaces interspaced by a series of recessed areas; a cylindrically shaped hinge integrally formed in each said recessed area; said extensions being so disposed along each said lower edges as to be received within a corresponding one of said recessed areas for assembly of said piece to said bottom piece; said profiles being configured to enable snap engagement or disengagement of said extensions with and from said hinges and to allow said side pieces to be moved alternatively between said outward foldback position and said erected position; said flat faces of said side pieces and said end pieces resting on said planar surfaces of said bottom piece in said erected position to prevent said side pieces and said end pieces to move inwardly to a folded position.

* * * * *